US006957609B2

(12) United States Patent
Ronn et al.

(10) Patent No.: US 6,957,609 B2
(45) Date of Patent: Oct. 25, 2005

(54) METHOD AND DEVICE FOR DISPERSING SUBMUNITIONS

(75) Inventors: Torsten Ronn, Karlskoga (SE); Jan Axinger, Storfors (SE)

(73) Assignee: Bofors Defence AB, Karlskoga (SE)

( * ) Notice: Subject to any disclaimer, the term of this patent is extended or adjusted under 35 U.S.C. 154(b) by 0 days.

(21) Appl. No.: 10/312,956

(22) PCT Filed: Jun. 20, 2001

(86) PCT No.: PCT/SE01/01399

§ 371 (c)(1),
(2), (4) Date: Mar. 31, 2003

(87) PCT Pub. No.: WO02/03013

PCT Pub. Date: Jan. 10, 2002

(65) Prior Publication Data

US 2003/0164110 A1 Sep. 4, 2003

(30) Foreign Application Priority Data

Jul. 3, 2000 (SE) ..... 0002495

(51) Int. Cl.[7] ..... F42B 12/56
(52) U.S. Cl. ..... 102/489
(58) Field of Search ..... 102/489, 494, 102/504, 505

(56) References Cited

U.S. PATENT DOCUMENTS

| | | | | | |
|---|---|---|---|---|---|
| 3,954,060 | A | * | 5/1976 | Haag et al. | 102/494 |
| 4,072,107 | A | | 2/1978 | Saxe et al. | |
| 4,388,869 | A | | 6/1983 | Edleson | |
| 4,388,870 | A | | 6/1983 | Edleson | |
| 4,455,943 | A | * | 6/1984 | Pinson | 102/489 |
| 4,676,167 | A | | 6/1987 | Huber, Jr. et al. | |
| 4,750,403 | A | | 6/1988 | Huber, Jr. et al. | |
| 5,005,483 | A | | 4/1991 | Deffayet | |
| 5,817,969 | A | | 10/1998 | Ettmuller | |
| 6,598,534 | B2 | * | 7/2003 | Lloyd et al. | 102/494 |
| 6,668,814 | B1 | * | 12/2003 | Borrell | 124/6 |
| 6,672,220 | B2 | * | 1/2004 | Brooks et al. | 102/489 |

FOREIGN PATENT DOCUMENTS

| | | | | | |
|---|---|---|---|---|---|
| FR | 2557286 | A | * | 6/1985 | F41F/7/00 |
| JP | 406273100 | A | * | 9/1994 | 102/489 |

* cited by examiner

*Primary Examiner*—Peter M. Poon
*Assistant Examiner*—Susan C. Alimenti
(74) *Attorney, Agent, or Firm*—Connolly Bove Lodge & Hutz LLP; Larry J. Hume

(57) ABSTRACT

The present invention relates to a method and a device for combating a pre-determined target with submunitions directed at the target from an airborne carrier in the form of a rocket, missile or equivalent (1) whereby the submunitions (17) are of the type whose main effect in target derives from impact with the target. As claimed in the present invention the submunitions (17) are given both a lateral motion vector (34) relative to the direction of flight of the carrier and a motion vector (35) in the direction of flight of the carrier. Jointly these motion vectors give the submunitions a resultant motion vector in a direction (36) towards the target. When the present invention is used the submunitions (17) are given the actual combined motion by the rotating magazine (5) in which they are stowed that rotates up to a high rate around the direction of flight of the carrier (1) before the submunitions leave the carrier when the centrifugal force gives them their lateral motion vector and they acquire their longitudinal motion vector from the direction of flight of the carrier.

24 Claims, 2 Drawing Sheets

Figures 1, 2:
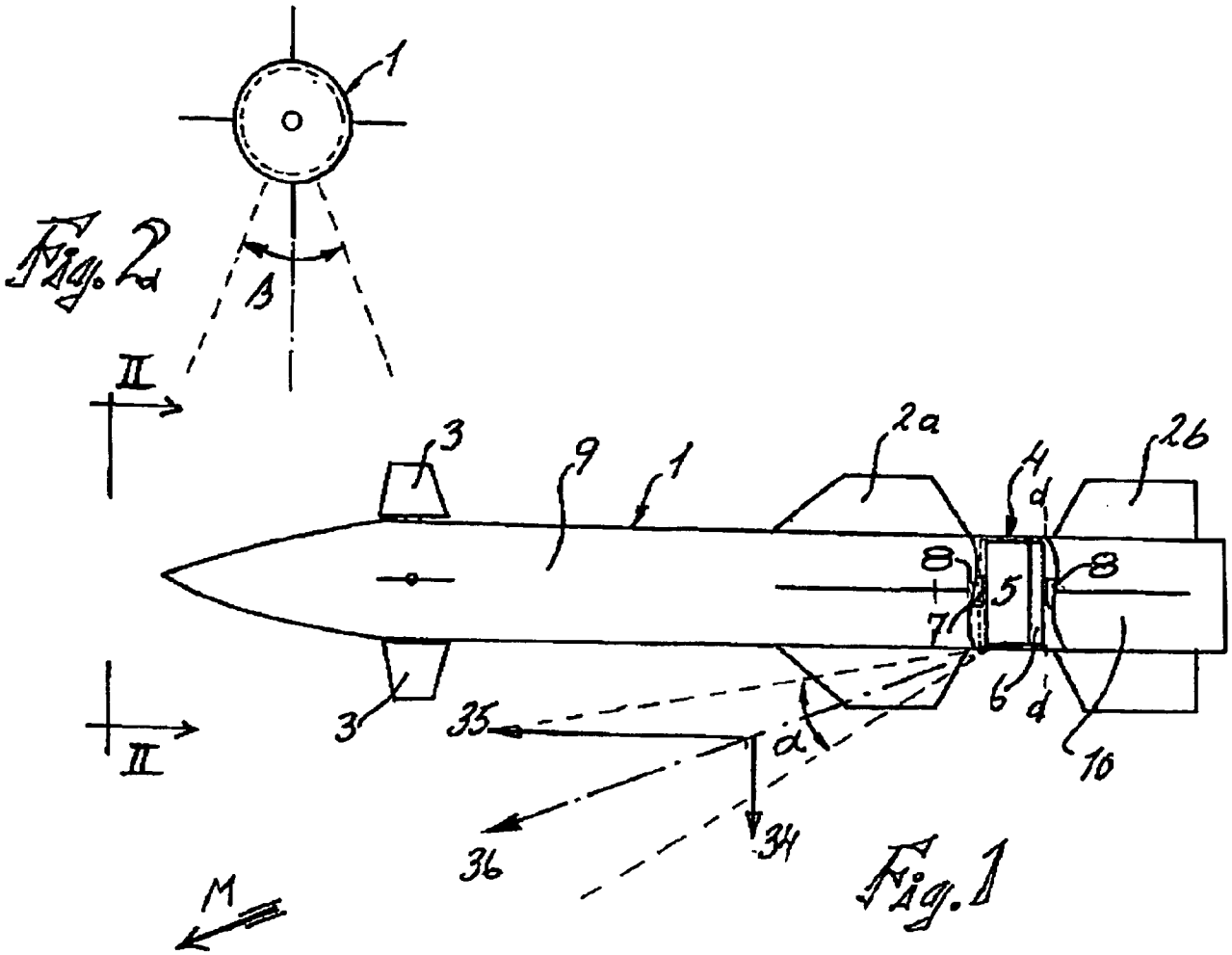

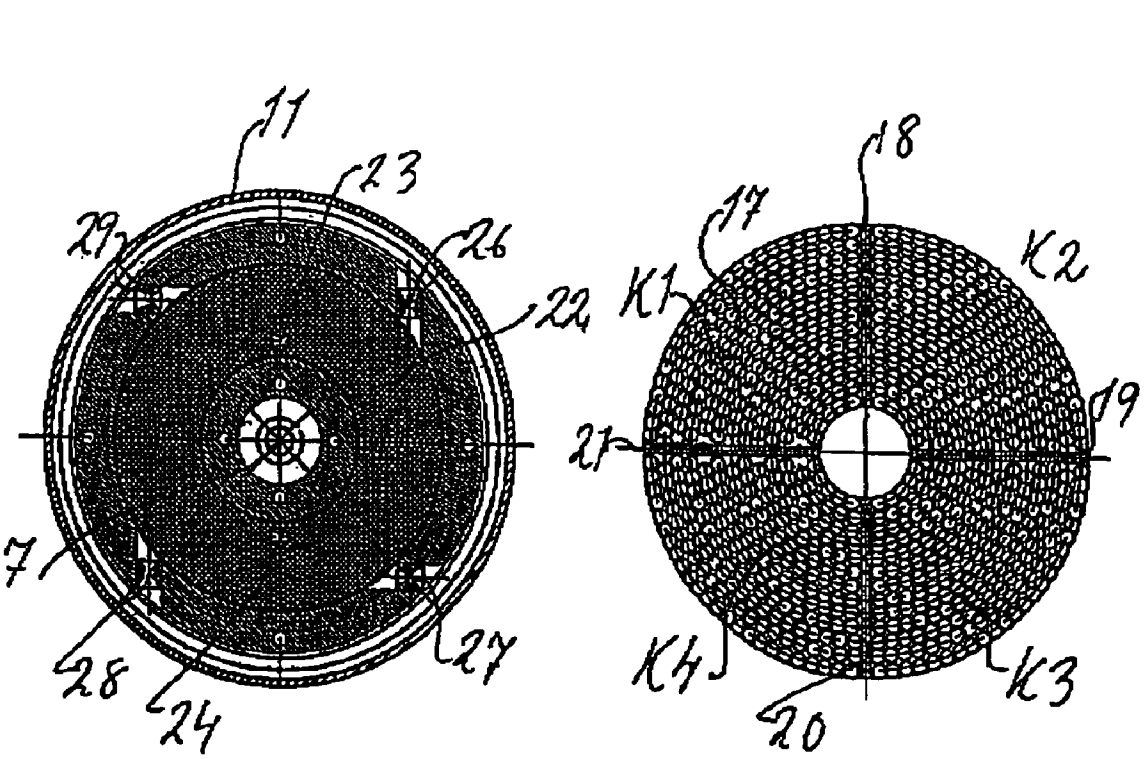
Fig. 5
Fig. 4
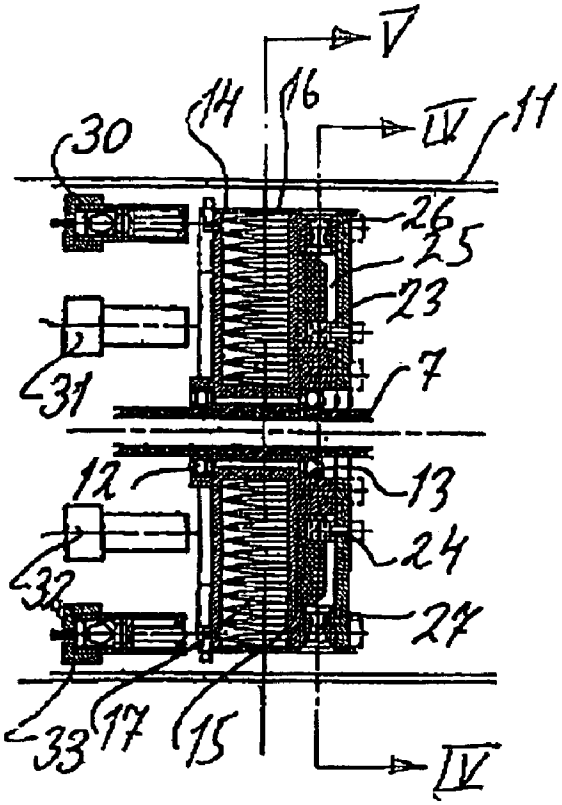
Fig. 3

METHOD AND DEVICE FOR DISPERSING SUBMUNITIONS

The present invention relates to a method and device for precision engagement of hostile targets by dispersing towards the target, from a flying non-rotating or slowly rotating carrier in the form of a rocket, missile or equivalent, a large quantity of submunitions that act by direct impact in the target via a combination of mass, inherent hardness and velocity. The submunitions in themselves can be of an elective type such as a cube, ball or dart.

Combating a target with fragments is currently the most common way of enhancing kill probability against targets that are difficult to combat by a direct hit because they have, for example, an extended surface or consist of numerous small units dispersed over a specific area. The most common method of achieving fragment dispersion must thereby be considered to be by using a detonating explosive charge to give the fragments their desired velocity and direction. The fragments in question can thereby be either pre-shaped before the explosive charge that is to disperse them is detonated, or can be formed during the actual detonation such as by bursting a fragmentation casing. One disadvantage of using a detonating charge to disperse large quantities of fragments is that the limits for true dispersion of fragments are, despite everything, relatively approximate and difficult to predict. This may apply especially when the fragments are formed by fragmenting a fragmentation casing since the fragments are then of many different sizes and thus fly different distances.

As already indicated the present invention relates to a method and device for attacking a pre-determined target with a well-defined cluster of submunitions which, just like fragments, act on impact and which are deployed from a specific carrier in the form of a rocket, missile or equivalent. The method and device as claimed in the present invention enable dispersion of, submunitions to be actuated with the shortest possible period of notice, while also enabling the dispersion pattern imparted to the fragments to be varied within certain constraints. As dispersion of the submunitions is intended to operate from the side of a carrier with a relatively high velocity the dispersed submunitions as claimed in the present invention will be given a forwards and lateral velocity vector relative to the carrier, which means that the submunitions from the carrier can be dispersed obliquely forwards relative to its own direction of flight. Dispersion of the submunitions can then be carried out either simultaneously all around the carrier or within a restricted angular zone relative to the cross-section of the carrier. The present invention also enables variation of the angle between the direction of flight of the carrier and the central axis of the cluster of submunitions emitted from the carrier. With regard to the submunitions we consider that special advantages are achievable if they are made dart-shaped, since dart-shaped submunitions as claimed in the method that is characteristic of the present invention can be given a stable flight and thereby a greater range and better penetration in the target. The method and device as claimed in the present invention for dispersing submunitions enables an evenly distributed dispersion pattern, which is ideal from the point of view of achieving a target kill.

The basic principle for the present invention is that a large number of the submunitions shall be maintained in a state of readiness in the carrier in a dedicated magazine comprising a number of concentric submunitions arranged in ring- or spiral-shaped layers whereby the submunitions in the magazine, if they have an elongated form like a dart for example, shall be located with their own longitudinal axis parallel with the direction of flight of the carrier. This magazine is rotatably journalled around a central axis that is preferably coincident with the longitudinal axis of the carrier, around which axis the magazine can then rotate up to a pre-determined rate while the submunitions are retained in the magazine. When the carrier approaches a target to be engaged the magazine rotates to a rate that provides the centrifugal force necessary to give the desired dispersion pattern in relation to the distance to the target. The magazine subsequently opens when the carrier has reached its intended engagement distance, whereby the submunitions in the magazine are released and dispersed along the directional vectors specified by the resultant of the centrifugal force in each direction and of the velocity of the carrier in its direction of flight Dispersion of the submunitions is then dependent on where they are located in the magazine since the submunitions located furthest from the centre of rotation of the magazine are propelled by the greatest centrifugal force thus being given the highest velocity vector lateral to the direction of flight of the carrier, while those nearest the centre of rotation are propelled by the lowest centrifugal force in the same direction, and the velocity vector imparted by the carrier in its own direction of flight is the same for all the submunitions.

By subdividing the magazine into a number of compartments, each preferably with a segmented circular cross-section format, the content of each such compartment can be released individually when the desired rotational position is attained, i.e. when it is directed at the target, thereby enabling a number of closely consecutive clusters of submunitions to be propelled towards the target during a very brief time interval. Each such compartment is thereby provided with its own peripheral outer wall segment, releasable on command, for retaining the submunitions until the correct stand-off distance to the target is reached.

Naturally, all the submunitions in the magazine can also be released simultaneously instead, in which case all the submunitions are dispersed all around the carrier.

As already indicated the device as claimed in the present invention is designed to be incorporated in a carrier in the form of a rocket, missile or equivalent, and such projectiles should preferably have a smooth outer casing to provide the least possible drag. Before dispersion of the submunitions can begin this outer casing must be eliminated and, as claimed in one version of the present invention, this is achieved by the carrier separating into two parts level with the magazine, each such part continuing along mainly the same stable flight path but with a somewhat different velocity and with a gradually increasing distance between them whereby the part that does not incorporate the submunition-dispersing magazine takes with it the parts of the carrier's outer walls that until the point of separation surrounded the magazine. The actual separation can be actuated by a small explosive charge.

The method and device as claimed in the present invention gives the submunitions an evenly distributed dispersion pattern, which is ideal from the point of view of achieving a target kill. It also enables very good capability for precision engagement of difficult targets, such as targets that one needs to engage while leaving their surroundings as far as possible undamaged. One advantage with the present invention is namely that one can specify very precisely in advance what the dispersion of the submunitions will be like, allied to the fact that under the same circumstances such dispersion will be very similar between different carrier units of the same type.

Because the device as claimed in the present invention also requires very little space it can be used as a complementary warhead in missiles that are already equipped with a major warhead, and thereby the proximity fuze of the main warhead and other sub-functions can also serve this complementary warhead. To be able to provide the desired result the device as claimed in the present invention usually needs access to information regarding distance and direction to the target as well as the relative velocity of the target, and such information should be obtainable from a proximity fuze or equivalent.

In a specially preferred design of the present invention a gas generator with a number of outlets arranged tangentially around its own periphery is used to accelerate the magazine to the desired rate of rotation, after which the submunitions are released via, for example, elimination of an outer retaining wall that keeps the submunitions in place until release.

The present invention is defined in more detail in the subsequent patent claims, and is now described in more detail with reference to the appended figures that illustrate one of several conceivable designs of a device designed in accordance with the present invention.

If required, each carrier unit can be equipped with more of the submunition magazines that are a characteristic feature of the present invention and if, when actuated, they are made to rotate in different directions the gyro effect that otherwise acts on the carrier can be eliminated.

In the appended figures

FIG. 1 shows a partially sectioned missile incorporating the device that is a characteristic feature of the present invention, FIG. 2 shows a section along line II—II in FIG. 1, FIG. 3 shows a lateral section of the device as claimed in the present invention to a larger scale and in more detail, FIG. 4 shows the section designated IV—IV in FIG. 3, and FIG. 5 shows the section designated V—V in FIG. 3.

The corresponding parts in the various figures have the same reference number irrespective of scale and degree of detail.

The missile illustrated in FIG. 1 has two arrays of aft fins 2*a* and 2*b* that each comprise four fins, four front control surfaces 3, and one submunition magazine 4 that is a characteristic feature of the present invention. The latter comprises in general terms a magazine section 5 and a propellant motor or gas generator section 6. The magazine 4 is journalled to be freely rotatable around a central axis that is coincident with the longitudinal axis of the missile.

These journals are designated 8. The front section 9 of the missile 1 contains its control system, possible target seeker and proximity fuze, as well as its main warhead and flight motor. The aft section 10 of the missile 1 contains the submunition magazine 4 and space to accommodate the missile's launch motor.

The submunition magazine 4 is shown in more detail with its constituent parts in FIGS. 3–5. FIG. 3 shows a section through parts 5 and 6. This includes parts of the outer casing 11 of the missile 1. As shown in the Figure the magazine section 5 and the gas generator section 6 are joined to each other and are journalled via ball bearings 12 and 13 to be freely rotatable around axis 7. Magazine section 5 comprises two mainly circular sidewalls 14 and 15, and between them a peripheral outer wall 16 forms space for a magazine which, as shown in FIGS. 3 and 5 is filled with dart-shaped submunitions 17 arranged in concentric circular layers with their own longitudinal axes parallel to axis 7. The magazine space between sidewalls 14 and 15 and the peripheral wall 16 is divided by four separating walls 18–21 into four quadrants or compartments K1–K4. The gas generator section 6 comprises a propellant charge 22, two initiation charges 23 and 24, a gas expansion chamber 25, and four tangentially arranged gas outlets 26–29. FIG. 3 also shows four explosive bolts 30–33 (in reality there are six explosive bolts in the device). The task of these explosive bolts is to remove, at a given command at the right point in time, that section of the peripheral wall 16 facing the target at the time for engagement. The peripheral wall 16 consists, namely, of a number of wall elements, each of which can be removed individually without the others being affected.

The device functions as described below. The proximity fuze, or other information source such as a remote command, provides data regarding distance and direction to the target relative to the flight path of the carrier (in FIG. 1 the direction to the target is indicated by the arrow M). When an engagement has been decided and is imminent the initiation charges 23 and 24 are ignited whereby propellant gases are generated that flow out through gas outlets 26–29 to accelerate sections 5–6 over a very brief interval to the rate of rotation calculated to give the desired dispersion of the dart-shaped submunitions 17. Simultaneously, or immediately preceding this, the carrier is separated along section line d—d shown in FIG. 1, whereby the parts of the outer casing surrounding the submunition magazine 4 and the explosive bolts 30–33 accompany the front section 9 of the carrier while the above mentioned components remain in the aft section 10 of the carrier where they are now exposed laterally. Thanks to their respective arrays of fins both carrier sections 9 and 10 continue along their original flight path after separation, but with a gradually increasing distance between them. The actual separation can be actuated by a pyrotechnic charge. When the carrier (missile) has reached the point in its flight path where submunitions 17 shall be fired, that part of the peripheral wall 16 of magazine section 5 that is facing the target at precisely that point in time is removed by the explosive bolts 30–33 to provide optimally directed dispersion of submunitions.

As illustrated in FIG. 1, when the dart-shaped submunitions leave the magazine they acquire from the centrifugal force a motion vector 34 directed radially outwards which, as previously mentioned, varies for the submunitions depending on their location in the magazine, together with a motion vector 35 acquired from the direction of flight of the missile. All in all these two motion vectors give the motion resultant 36. Furthermore, the submunitions acquire dispersion around this main direction as determined by their original locations in the magazine. The angle of dispersion is designated a. As the magazine comprises, for example, four quadrants K1–K4 containing dart-shaped submunitions, each compartment can be fired in sequence in the same direction as soon as each quadrant reaches the position when it is facing the target. At the same time as the submunitions 17 acquire a longitudinal dispersion as illustrated in FIG. 1 they also acquire a certain lateral dispersion, and as they are fired in the indicated manner—each magazine quadrant in sequence—the lateral dispersion is calculated to be the same for all quadrants, and in this case this dispersion is equivalent to angle $\beta$.

We claim:

1. A method of firing submunitions, comprising:

providing an airborne carrier having a magazine rotatably mounted with respect to a front section of a missile, the magazine housing a plurality of submunitions;

activating a gas generator, wherein gases from the gas generator cause the magazine to rotate;

rotating the magazine relative to the front section of the airborne carrier to exert centrifugal forces on the submunitions; and allowing the submunitions to leave the magazine.

2. The method of claim 1, wherein the gas generator comprises a plurality of peripheral openings, the openings being disposed to direct the gases from the gas generator to rotate the magazine.

3. The method of claim 1, comprising:

separating the front section of the airborne carrier from an aft section of the carrier, wherein the magazine remains in the aft section.

4. The method of claim 3, wherein the submunitions leave the magazine due to the centrifugal forces on the submunitions.

5. The method of claim 4, wherein the gas generator comprises a plurality of peripheral openings, the openings being disposed to direct the gases from the gas generator to rotate the magazine.

6. The method of claim 5, comprising:

removing at least a part of a peripheral wall from a periphery of the magazine after separation of the front section from the aft section.

7. The method of claim 6, wherein the submunition are provided a lateral motion vector away from the airborne carrier by the centrifugal forces.

8. The method of claim 1, wherein the gas generator is activated when an engagement has been decided, the gas generator causing the magazine to rotate up to a desired speed.

9. The method of claim 1, comprising:

separating a front section of the carrier from an aft section of the carrier, wherein the magazine remains in the aft section; and removing at least a part of a peripheral wall from a periphery of the magazine after separation of the front section from the aft section.

10. The method of claim 1, comprising:

removing at least a part of the peripheral wall surrounding the magazine based on a location of a target.

11. The method of claim 10, wherein parts of the peripheral wall are removed as sectors of submunitions surrounded by a corresponding part of the peripheral wall coincide with a direction to the target.

12. An airborne carrier, comprising:

a front section;

an aft section;

a gas generator disposed to emit gases to cause a magazine to rotate; and the magazine rotatably mounted with respect to a front section of a missile, the magazine housing a plurality of submunitions.

13. The airborne carrier of claim 12, wherein the gas generator comprises a plurality of peripheral openings, the openings being disposed to direct the gases from the gas generator to rotate the magazine.

14. The airborne carrier of claim 12, comprising:

means for separating a front section of the carrier from an aft section of the carrier, wherein the magazine is fixedly mounted in the aft section.

15. The airborne carrier of claim 14, wherein the submunitions are concentrically arranged in the magazine.

16. The airborne carrier of claim 14, wherein the magazine includes separating walls that divide the submunitions into compartments.

17. The airborne carrier of claim 12, wherein the gas generator is a disc-shaped gas generator having an axis that is coincident with an axis of rotation of the magazine.

18. The airborne carrier of claim 12, wherein the magazine and gas generator are mounted on ball bearings on an axis.

19. The airborne carrier of claim 12, wherein the magazine is mounted on at least one journal.

20. The airborne carrier of claim 19, wherein the submunitions are concentrically arranged in the magazine, and wherein the magazine includes separating walls that divide the submunitions into compartments.

21. The airborne carrier of claim 12, comprising: a peripheral wall surrounding the magazine.

22. The airborne carrier of claim 21, wherein the peripheral wall comprises a plurality of removable wall elements, and wherein the submunitions are divided into a plurality of sectors.

23. The airborne carrier of claim 22, comprising means for removing individual removable wall elements as a sector of submunitions surrounded by that part of the peripheral wall element coincides with a direction to the target.

24. The airborne carrier of claim 12, comprising:

a plurality of fins disposed on an exterior of the airborne carrier.

* * * * *